US006168404B1

(12) United States Patent
Gatecliff

(10) Patent No.: US 6,168,404 B1
(45) Date of Patent: Jan. 2, 2001

(54) SCROLL COMPRESSOR HAVING AXIAL COMPLIANCE VALVE

(75) Inventor: George W. Gatecliff, Saline, MI (US)

(73) Assignee: Tecumseh Products Company, Tecumseh, MI (US)

( * ) Notice: Under 35 U.S.C. 154(b), the term of this patent shall be extended for 0 days.

(21) Appl. No.: 09/212,340

(22) Filed: Dec. 16, 1998

(51) Int. Cl.[7] ..... F04C 18/00
(52) U.S. Cl. ..... 418/55.5; 418/55.6; 418/57
(58) Field of Search ..... 418/55.5, 55.6, 418/57

(56) References Cited

U.S. PATENT DOCUMENTS

| | | | | |
|---|---|---|---|---|
| Re. 35,216 | | 4/1996 | Anderson et al. . | |
| 4,350,479 | | 9/1982 | Tojo et al. . | |
| 4,435,137 | | 3/1984 | Terauchi . | |
| 4,519,413 | | 5/1985 | Wagenseil et al. . | |
| 4,596,520 | * | 6/1986 | Arata et al. | 418/55 |
| 4,645,437 | | 2/1987 | Sakashita et al. . | |
| 4,669,962 | * | 6/1987 | Mizumo et al. | 418/55 |
| 4,696,630 | | 9/1987 | Sakata et al. . | |
| 4,767,293 | | 8/1988 | Caillat et al. . | |
| 4,810,176 | | 3/1989 | Suefuji et al. . | |

(List continued on next page.)

FOREIGN PATENT DOCUMENTS

| | | | | |
|---|---|---|---|---|
| 58-160580 | | 9/1983 | (JP) . | |
| 58-160583 | | 9/1983 | (JP) . | |
| 60-228787 | | 11/1985 | (JP) . | |
| 249686 | * | 12/1985 | (JP) | 418/55.5 |
| 61-258989 | | 11/1986 | (JP) . | |
| 0138183 | | 6/1988 | (JP) . | |
| 163485 | * | 6/1989 | (JP) | 418/55.5 |
| 405001677 | * | 6/1989 | (JP) | 418/55.5 |
| 253581 | * | 10/1989 | (JP) | 418/55.5 |
| 218880 | * | 8/1990 | (JP) | 418/55.5 |
| 64-98829 | | 11/1990 | (JP) . | |
| 3-64686 | | 3/1991 | (JP) . | |
| 2-293889 | | 6/1992 | (JP) . | |
| 3-105289 | | 11/1992 | (JP) . | |
| 404334784 | * | 11/1992 | (JP) | 418/55.5 |
| 3-156586 | | 1/1993 | (JP) . | |

* cited by examiner

*Primary Examiner*—Thomas Denion
*Assistant Examiner*—Theresa Trieu
(74) *Attorney, Agent, or Firm*—Baker & Daniels

(57) ABSTRACT

A scroll compressor assembly including a first scroll device having a first involute wrap element projecting from a first substantially planar surface, a second scroll device having a second involute wrap element projecting from a second substantially planar surface and a third surface facing oppositely the second surface, the first and second scroll devices adapted for mutual engagement with the first involute wrap element projecting toward the second surface and the second involute wrap element projecting toward the first surface, the first surface positioned substantially parallel with the second surface, whereby relative orbiting motion of the first and second surfaces compresses fluids between the involute wrap elements, a first source of a first fluid under a pressure intermediate suction pressure and discharge pressure and located between the first and second scroll wrap elements, a frame partly defining a chamber containing a quantity of a second fluid under pressure, and a valve in fluid communication with the first source of the first fluid and a second source of the second fluid substantially at the discharge pressure, the chamber and the second source out of communication in a first valve position, the chamber and the second source in communication in a second valve position, the valve activated by the fluid pressure of the first source, whereby the first and second scroll wrap elements are maintained in controlled axial sealing engagement against the second and first surfaces, respectively.

51 Claims, 4 Drawing Sheets

U.S. PATENT DOCUMENTS

| | | |
|---|---|---|
| 4,877,382 | 10/1989 | Caillat et al. . |
| 4,928,503 | 5/1990 | Riffe . |
| 4,950,135 | 8/1990 | Tojo et al. . |
| 4,992,033 | 2/1991 | Caillat et al. . |
| 4,993,928 | 2/1991 | Fraser, Jr. . |
| 5,131,828 | 7/1992 | Richardson, Jr. et al. . |
| 5,152,682 | 10/1992 | Morozumi et al. . |
| 5,211,550 | 5/1993 | Kawabe . |
| 5,217,359 | 6/1993 | Kawahara et al. . |
| 5,242,284 | 9/1993 | Mitsunaga et al. . |
| 5,263,822 | 11/1993 | Fujio . |
| 5,277,563 | 1/1994 | Wen-Jen et al. . |
| 5,295,813 | 3/1994 | Caillat et al. . |
| 5,383,772 | 1/1995 | Richardson, Jr. et al. . |
| 5,447,418 | 9/1995 | Takeda et al. . |
| 5,468,130 | 11/1995 | Yamada et al. . |
| 5,520,526 | 5/1996 | Fujio . |
| 5,562,435 | 10/1996 | Cho et al. . |
| 5,588,820 | 12/1996 | Hill et al. . |
| 5,591,014 | 1/1997 | Wallis et al. . |
| 5,593,295 | 1/1997 | Hill . |
| 5,607,288 | 3/1997 | Wallis et al. . |
| 5,611,674 | 3/1997 | Bass et al. . |
| 5,622,488 | 4/1997 | Tojo et al. . |

SCROLL COMPRESSOR HAVING AXIAL COMPLIANCE VALVE

BACKGROUND OF THE INVENTION

1. Field of the Invention

The present invention relates generally to scroll compressors which include fixed and orbiting scroll members and, more particularly, to a valve which regulates a pressure intermediate suction and discharge pressures to maintain sealing axial engagement between the orbiting scroll member and the fixed scroll member.

2. Description of the Related Art

A typical scroll compressor comprises two facing scroll members, each having an involute wrap wherein the respective wraps interfit to define a plurality of closed compression pockets. When one of the scroll members is orbited relative to the other member, the pockets decrease in volume as they travel between a radially outer suction port and a radially inner discharge port. The pockets thereby convey and compress a fluid, typically a refrigerant, contained therein.

During compressor operation, the pressure of the compressed refrigerant tends to force the scroll members axially apart. Axial separation of the scroll members causes the closed pockets to leak at the interface between the wrap tips of one scroll member and the face of the other scroll member. Such leakage reduces the operating efficiency of the compressor and, in extreme cases, may result in the inability of the compressor to operate.

Efforts to counteract the separating force applied to the scroll members during compressor operation, and thereby minimize the aforementioned leakage, have resulted in the development of a variety of axial compliance mechanisms. For example, it is known to axially preload the scroll members toward each other with a force sufficient to resist the dynamic separating force. One approach is to assure close manufacturing tolerances for the component parts and have a thrust bearing interface between the fixed and orbiting scroll members for conveying axial forces between the members. The most common approach is to feed back compressed refrigerant gas to urge the two scroll members together.

Typically, the axial compliance forces bias the tips of the scroll compressor wraps against the inner surface of the opposite scroll and/or may bias sliding surfaces on the outer perimeter of the two scroll members into mutual engagement. Frictional forces are created at these areas of contact as the moveable scroll is orbited about the fixed scroll. Excessive frictional forces generated by the axial compliance mechanism can increase the power required to operate the scroll compressor and have an abrasive effect on the engagement surfaces. The abrasive effects created by the axial compliance forces can damage or lead to wearing of the wrap tips and interior surfaces, or faces, of the two scrolls when excessive axial compliance forces are borne by these surfaces and thereby negatively impact the sealing ability and longevity of the wrap tips.

Some prior art scroll compressors provide passageways in the orbiting scroll member plate through which a portion of the compression chamber formed by the interfitting scroll wraps, in which refrigerant is at intermediate pressure, is in direct fluid communication with an intermediate pressure chamber formed in part by the side of orbiting scroll member opposite that on which scroll wraps are disposed. The refrigerant gas in the intermediate pressure chamber exerts an axial sealing force between the orbiting and fixed scroll members. However, under certain operating conditions such arrangements can create intermediate pressures greater than discharge pressure, forcing the fixed and orbiting scroll members together too tightly, resulting in compressor inefficiency. A method of regulating the pressure of a fluid, which may be gas or liquid, which biases the fixed and orbiting scroll members into consistent and proper sealing engagement under varying compressor operating conditions is needed.

SUMMARY OF THE INVENTION

The present invention provides a pressure regulation valve for regulating the pressure of a fluid to bias the orbiting scroll member into consistent, proper sealing engagement with the fixed scroll member under varying operating conditions. The regulation of this axial compliance pressure by the inventive valve reduces frictional power losses and maintains the tips and interior surfaces of the fixed and orbiting scrolls at fixed relative axial positions.

A scroll compressor assembly according to the present invention thus includes a first scroll device having a first involute wrap element projecting from a first substantially planar surface and a second scroll device having a second involute wrap element projecting from a second substantially planar surface, the first and second scroll devices adapted for mutual engagement with the first involute wrap element projecting toward the second surface and the second involute wrap element projecting toward the first surface. The first surface is positioned substantially parallel with the second surface and the second scroll device further has a third surface facing oppositely the second surface. Relative orbiting motion of the first and second surfaces compresses fluids between the involute wrap elements. A first source of a first fluid under a pressure intermediate suction pressure and discharge pressure is located between the first and second scroll wrap elements. A frame partly defines a chamber containing a quantity of a second fluid under pressure. A valve is provided in fluid communication with the first source of the first fluid and a second source of the second fluid substantially at the discharge pressure. The chamber and the second source are out of communication in a first valve position, and are in communication in a second valve position. The valve is activated by the fluid pressure of the first source. Through this arrangement, the first and second scroll wrap elements are thus maintained in controlled axial sealing engagement against the second and first surfaces, respectively.

The present invention also provides a scroll compressor assembly having a first scroll member having a first involute wrap element projecting from a first substantially planar surface, a second scroll member having a second involute wrap element projecting from a second substantially planar surface and a third surface opposite its second surface. The first and second scroll members are adapted for mutual engagement with the first involute wrap element projecting toward the second surface and the second involute wrap element projecting toward the first surface, the first and second surfaces positioned substantially parallel relative to each other and relative orbiting of the scroll members compresses fluids between their involute wrap elements. The compressor assembly also includes a first source of a first fluid under a pressure between suction pressure and discharge pressure, and a frame which partly defines a chamber which contains a quantity of a second fluid under pressure. Means are provided for automatically controlling the axial compliance forces between said first and second scroll devices. Thus present invention thus maintains the first and second scroll members in controlled axial sealing engagement.

An advantage of the present invention is that by utilizing the pressure regulation valve to control the pressure of the axial compliance medium, which may be gas or liquid, the wrap tips do not bear excessive axial compliance forces. With the axial compliance force controlled, the orbiting and fixed scroll members are axially forced together by the axial compliance medium, or allowed to be axially forced apart by the gas pressures between the scroll wraps, to such a degree that the frictional contact between the wrap tip/scroll plate interface is properly maintained, providing an appropriate balance between frictional losses and sealing effectiveness. The controlled axial compliance force allows the wrap tips to wear-in properly against its scroll plate interface and the orbiting and fixed scroll members to achieve proper and substantially constant relationships relative to one another.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
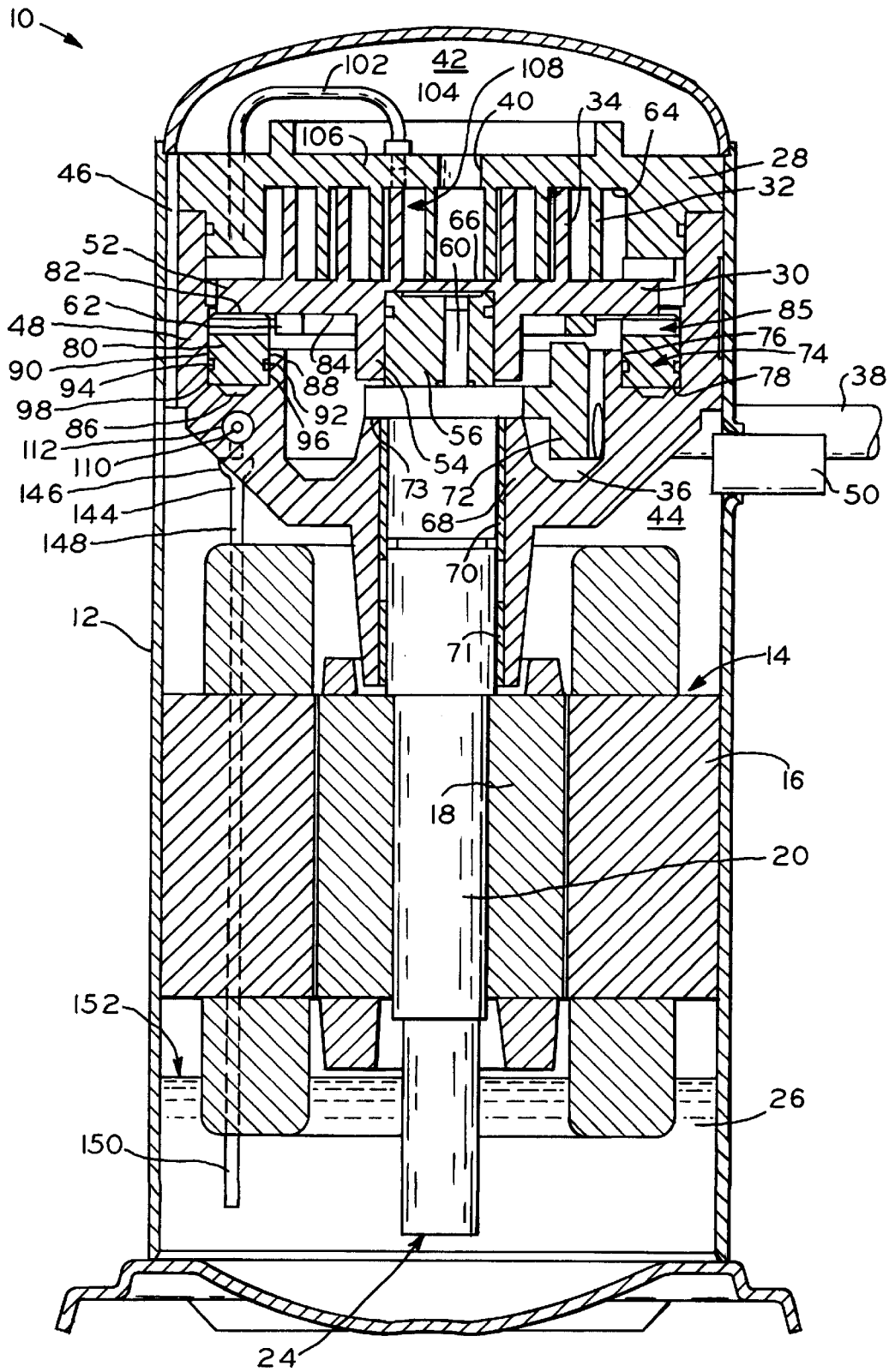
FIG. 1 is a longitudinal sectional view of a scroll compressor assembly according to a first embodiment of the present invention.

Corresponding reference characters indicate corresponding parts throughout the several views. The drawings, which represent embodiments of the present invention, are not necessarily to scale and certain features may be exaggerated. Although the exemplification set out herein illustrates embodiments of the invention in several forms, the embodiments disclosed below are not intended to be exhaustive or limit the invention to the precise forms disclosed in the following detailed description and are not to be construed as limiting the scope of the invention in any manner.

DESCRIPTION OF THE PRESENT INVENTION

Figure 2:
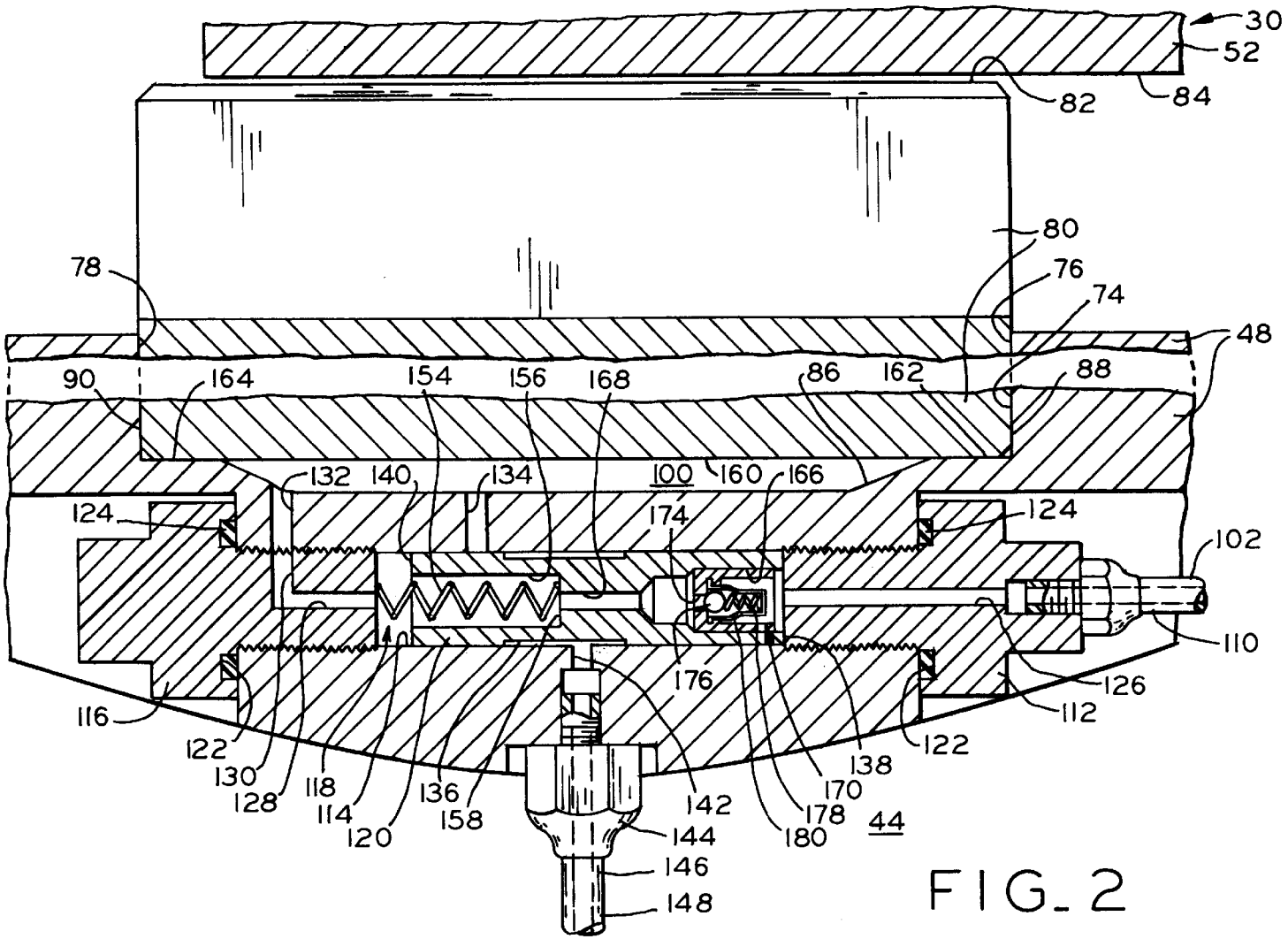
FIG. 2 is an enlarged, fragmentary sectional view of the upper portion of the scroll compressor assembly of FIG. 1, showing the axial compliance valve thereof in its first position.
Figure 3:
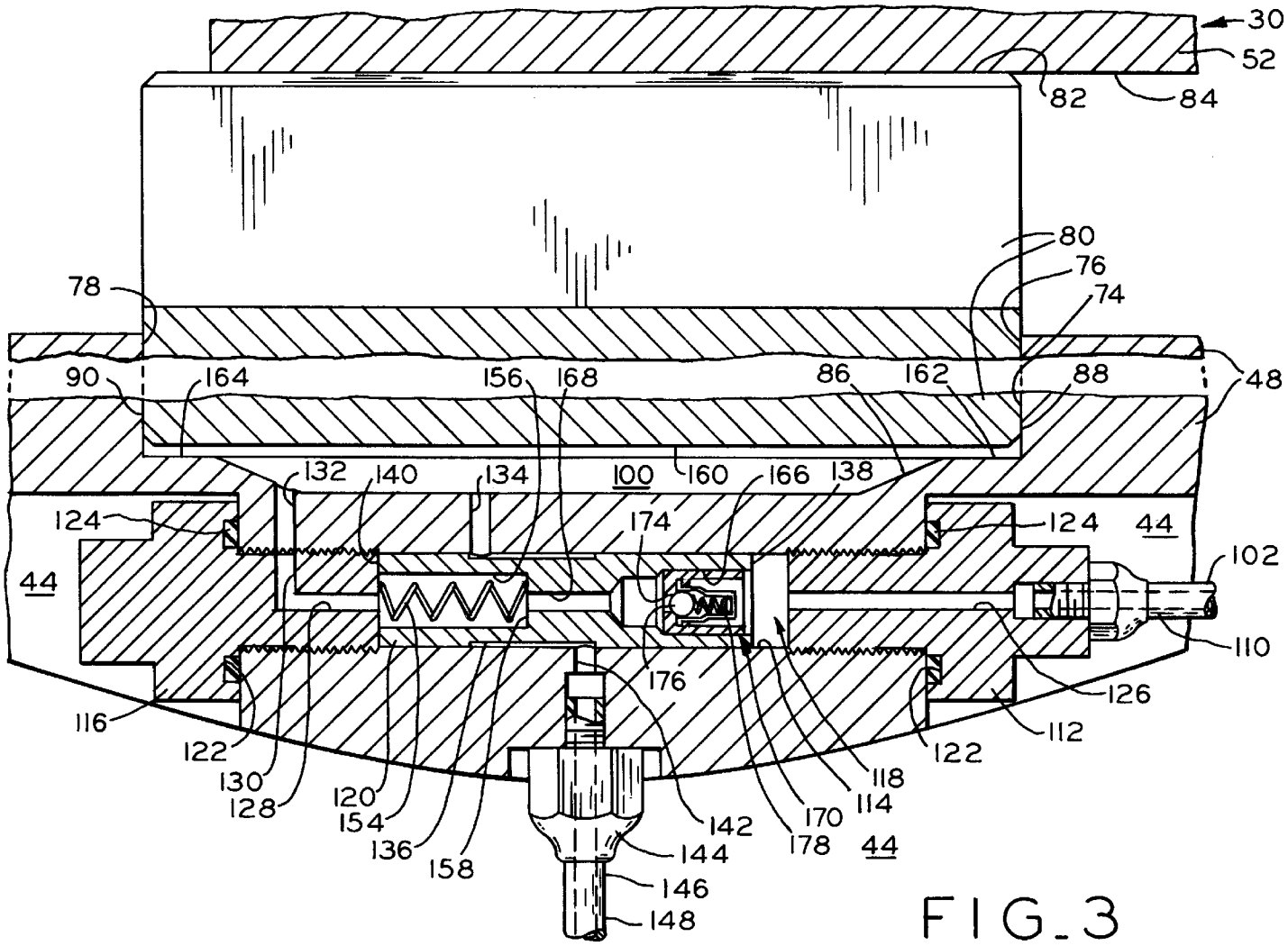
FIG. 3 is an enlarged, fragmentary sectional view of the upper portion of the scroll compressor assembly of FIG. 1, showing the axial compliance valve thereof in its second position.

Referring now to the drawings and particularly to FIGS. 1–3, there is shown scroll compressor assembly 10 according to a first embodiment of the present invention, comprising housing 12, motor 14 having stator 16 and rotor 18, and crankshaft 20 upon which rotor 18 of motor 14 is attached. Oil pump 24 is provided in the terminal end of shaft 20, by which oil is moved from sump 26 located in the lower portion of housing 12 to lubricated parts of the compressor. Scroll compressor assembly 10 further includes fixed scroll member 28 and orbiting scroll member 30 having volute shaped scroll element, or wrap, 32 and 34 respectively. Scroll wraps 32, 34 interfit and are used to compress gases therebetween in a well known manner by orbiting scroll member 30 relative to scroll member 28. Scroll compressors are well-known in the art and U.S. Pat. Nos. 5,131,828 and 5,383,772, which provide disclosures of the structure and operation of scroll compressors and are assigned to the assignee of the present invention, are expressly incorporated herein by reference. In general, refrigerant at suction pressure is drawn from the refrigeration system loop (not shown) which may comprise, in addition to compressor assembly 10, conduits, heat exchangers and an accumulator or receiver, into suction pressure chamber 36 through suction tube 38 and introduced into the region between intermeshed scroll wraps 32, 34. The refrigerant gas is compressed therebetween by their relative orbiting motion and expelled from between the scroll wraps through discharge port 40 provided near the center of fixed scroll member 28 and into first discharge pressure chamber 42 located in the uppermost region of housing 12. First discharge pressure chamber 42 is in fluid communication with second discharge pressure chamber 44 located in the lower portion of housing 12 through communicating passages 46 extending between the inside wall of housing 12, and fixed scroll member 28 and frame 48, which are attached together by, for example, a plurality of bolts (not shown). Discharge tube 50 opens into chamber 44 and conveys discharge pressure fluid back into the refrigeration system loop.

Orbiting scroll member 30 includes planar portion 52 and depending pedestal portion 54 which is rotatably disposed about roller 56 and an intermediate bearing (not shown). Roller 56 is journaled about or fixedly mounted to eccentric crankpin 60 of crankshaft 20. Anti-rotation means such as, for example, Oldham coupling ring 62 disposed between scroll members 28 and 30, are used to prevent orbiting scroll 30 from rotating about its own axis as it orbits about the axis of crankshaft 20.

As orbiting scroll member 30 moves and refrigerant gas is compressed between scroll wraps 32, 34, a separating force is created which acts on fixed and orbiting scroll member inner faces 64 and 66, from which wraps 32 and 34 respectively extend. The force generated by the compressed fluid tends to axially separate scroll members 28, 30. Through use of the present invention, orbiting scroll member 30 can be biased towards fixed scroll 28 during compressor operation to overcome the axial separation force and properly maintain the mutual engagement of scroll members 28, 30.

Figure 4:
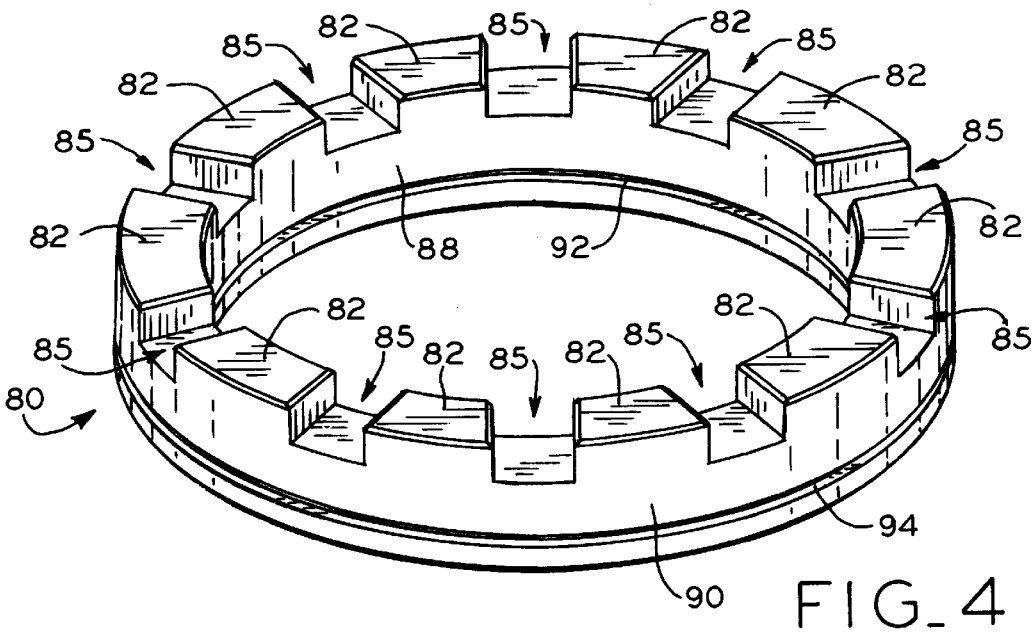
FIG. 4 is a perspective view of the annular piston of the compressor assembly of FIG. 1.

Frame 48 of compressor assembly 10 includes main bearing portion 68 which radially supports crankshaft 20 through upper and lower journal bearings 70, 71, respectively. A recessed portion of frame 48 adjacent main bearing portion 68 receives orbiting scroll member pedestal portion 54 and counterweight 72, which is attached to crankshaft 20. Thrust surface 73 axially supports shaft 20 on frame main bearing portion 68. Suction pressure gas received in chamber 36 is swirled by the motion of rotating counterweight 72, and flows radially outward and axially upward above orbiting scroll planar portion 52 to be received between the scroll wraps. Frame 48 also includes annular cavity 74 having concentric inner and outer cylindrical walls 76 and 78, respectively. Annular piston 80 is slidably disposed in cavity 74, its upper surfaces 82 in abutting contact with lower surface 84 of orbiting scroll planar portion 52. As shown in FIG. 4, surfaces 82 are circumferentially segmented and equally distributed about the upper periphery of piston 80, separated by recesses 85. Suction pressure gas flows through recesses 85 as it is drawn from suction chamber 36 to the compression space between the scroll wraps (FIG. 1). As shown, piston 80 has ten surfaces 82, although a piston having a different number of multiple upper surfaces or even a single, continuous surface 82 may be used. As will be described further below, in this first embodiment of the present invention, the communication of force between piston 80 and orbiting scroll member 30 is automatically regulated and controls the axial compliance between the orbiting and fixed scroll members. Further, those skilled in the art will recognize that piston 80 also serves to stabilize the orbiting scroll member, preventing tilting or wobbling thereof by exerting a force which is distributed near the outer periphery of the orbiting scroll members' planar underside surface.

The bottom of annular cavity 74 is provided with annular channel 86. Inner and outer cylindrical piston sidewalls 88 and 90, respectively, slidably engage adjacent inner and outer cavity sidewalls 76, 78. Piston sidewalls 88, 90 are each provided with circumferential grooves 92, 94 in which are disposed seals 96, 98. It can be readily envisioned that chamber 100, defined by the sides and bottom of annular cavity 74 and all surfaces of piston 80 disposed below seals 96, 98, is expands and contracts with the vertical motion of piston 80 in cavity 74.

As an incompressible fluid such as oil is forced under pressure into chamber 100, the chamber volume is increased and upper piston surfaces 82 are urged with increased force against surface 84 of orbiting scroll member 30. Conversely, as oil exits chamber 100, the chamber volume and the force with which piston 80 engages orbiting scroll member 30 both decrease. Those skilled in the art will recognize that if a compressible fluid such as refrigerant gas is similarly forced into and exits from chamber 100, the attendant volume changes and piston forces will not be as proportional as in the case of oil, due to compression of the gas, but they will positively correlate.

Further, employing a liquid rather than a gas medium in the apparatus of the present invention provides a damping effect which better prevents sudden and dramatic increases and decreases in the volume of chamber 100. The use of a liquid rather than a gas axial compliance medium in a compressor assembly according to the present invention provides the additional benefit of piston 80 acting more like a shock absorber, better preventing undesirable, intermittent changes in the wrap tip-to-scroll face contact due to the liquid medium's relatively greater inertia.

Referring to FIGS. 1–3, compressor assembly 10 is provided with tubular conduit 102 having first end 104 (FIG. 1) which extends into an aperture through planar portion 106 of fixed scroll member 28 and communicates with space 108 between interleaved scroll wraps 32, 34 and in which refrigerant gas is at a pressure $P_i$ which is intermediate the suction and discharge pressures during compressor operation. The outer surface of tube first end 104 is sealed to fixed scroll member 28 such that there is no leakage of discharge gas from first discharge chamber 42 therealong back into space 108. Space 108 may be located at various positions depending on access thereto and the available quality of intermediate pressure $P_i$. It should be understood that conduit 102 need not necessarily be formed from a tube nor approach space 108 through fixed scroll portion 106 as shown, or even tap into space 108 through fixed scroll member 28 at all, and the scope of the present invention should not be interpreted as being so limited.

Conduit 102 is routed such that second end 110 thereof (FIGS. 2, 3) is attached to and sealed within first plug 112, which is threadedly received in one end of bore 114 provided in frame 48. As shown in FIG. 1, bore 114 extends through frame 48 below annular cavity 74 in a direction tangential to the surface of an imaginary cylinder (not shown) which is concentric with cavity 74, although bore 114 is shown approximately perpendicular to this orientation (i.e. extending radially) in FIGS. 2 and 3 for explanatory purposes. Second plug 116 is threadedly received in the opposite end of bore 114, and with plug 112 encloses cylindrical chamber 118 in which cylindrical valve 120 moves longitudinally. First and second plugs 112, 116 are provided with annular grooves 122 in which are disposed seals 124, which serve to help the plugs seal valve chamber 118 from second discharge chamber 44. Valve 120 freely moves within but is closely fitted to bore 114 such that only a slight clearance exists between their respective adjacent cylindrical surfaces. Regardless of whether the axial compliance medium used with the present invention is gas or liquid, it is not necessary for the circumferential fit between valve 120 and bore 114 to approach a fluid-tight seal therebetween; it is sufficient that the flow of fluid therebetween only be impeded enough to permit its proper operation of the invention axial compliance mechanism as described hereinbelow.

First plug 112 is provided with axial bore 126 through which second conduit end 110 communicates with valve chamber 118. Second plug 116 is provided with axial bore 128 and intersecting crossbore 130. Crossbore 130 communicates with passage 132 which extends from the threaded portion of bore 114 to annular channel 86 provided at the bottom of cavity 74, placing chamber 100 in fluid communication with valve chamber 118. Frame 48 is also provided with passage 134 which extends between annular channel 86 and bore 114. Chamber 100 is out of communication with wide annular groove 136 formed in the outer cylindrical surface of valve 120 when valve 120 is in its first position, shown in FIG. 2, and is in communication with groove 136 when valve 120 is in its second position, shown in FIG. 3. In the first valve position, annular surface 138 of valve 120 abuts the interior face of first plug 112; in the second valve position, annular surface 140 of valve 120 abuts the interior face of second plug 116.

In all valve positions, annular groove 136 remains in communication with passage 142, which extends through frame 48 to bore 114. Where refrigerant gas is used as the axial compliance medium, passage 142 may open directly into second discharge chamber 44. Alternatively, where oil is used as the axial compliance medium, fitting 144 may be threadedly received in passage 142, connecting passage 142 with first end 146 of tubular conduit 148, which extends downward such that its second end 150 opens into sump 26, well below oil level 152 (FIG. 1). Because chamber 44 is at discharge pressure, fluid (oil or refrigerant gas) will tend to flow upward through conduit 148 and/or passage 142 to valve groove 136.

Valve 120 is provided with compression spring 154 disposed in counterbore 156 which annular surface 140 surrounds. Spring 154 abuts the interior face of second plug 116 and annular surface 158 at the end of counterbore 156, and urges valve 120 into its first position, in which its annular surface 138 abuts the interior face of first plug 112. With compressor assembly 10 at rest, pressures therein and throughout the refrigerant system loop are normalized at pressure $P_n$. The first valve position is thus assumed and chamber 100 is at its minimum volume, with no substantive net force acting upward on piston 80, lower surface 160 thereof resting on annular surfaces 162, 164 of cavity 74, located respectively inside and outside of channel 86.

For valve 120 to be moved from its first position towards its second position against the force of spring 154, intermediate pressure $P_i$ of space 108, which acts on one end of the valve via conduit 102, must exceed controlled pressure $P_c$ in chamber 100, which acts in conjunction with spring 154 on the opposite end of the valve, by approximately 5 to 10 psi. Valve 120 and spring 154 may instead be sized to move from the first towards the second valve position under the influence of other pressure differentials, depending on the characteristics of the compressor assembly, and the scope of the present invention should not interpreted as being limited to the above valve actuation point.

Valve 120 is also provided with counterbore 166 which annular surface 138 surrounds. Counterbores 156, 166 communicate through axial bore 168 which extends therebetween along the central axis of valve 120. Within counterbore 166 is interference fitted check valve assembly 170, which may be an 855 Series Chek Valve™ produced by The Lee Company of Westbrook, Conn. Check valve assembly 170 comprises somewhat cup-shaped cylindrical shell 170 provided with central aperture 174 which provides a seat for check ball 176, which is urged thereagainst by compression spring 178 retained within cage 180 attached to the interior of shell 170. Hence, with valve 120 in its first position (FIG. 2), fluid may flow from chamber 100 to intermediate pressure space 108 through valve 120 when ball 176 is urged off its seat against the force of spring 178. This occurs only when controlled pressure $P_c$ in chamber 100 is greater than intermediate pressure $P_i$ in space 108 by at least approximately 5 to 10 psi. Check valve assembly 170 may be sized to open at other pressure differential ranges, depending on the characteristics of the compressor assembly, and the scope of the present invention should not interpreted as being limited to the above check valve opening point.

In operation, just before compressor assembly 10 is started, piston 80 is at its lowest position in cavity 74, its lower surface 160 resting on annular surfaces 162, 164, and valve 120 is in its first position, as shown in FIG. 2. The fluid pressure within chamber 100 and throughout the refrigerant system loop is at $P_n$, which is higher than operating suction pressure and lower than the operating discharge pressure. Upper piston surfaces 82 may be in light abutting contact with adjacent lower surface 84 of orbiting scroll member 30, under the weight of member 30, or slightly separated therefrom, as shown in FIG. 2. Once compressor 10 starts, refrigerant gas pressures between the scroll wraps increase, forcing fixed and orbiting scroll members 28, 30 axially apart. Pressure level $P_i$, intermediate the operating suction and discharge pressures, is transmitted via conduit 102 from space 108 to the right side of valve 120 as viewed in FIGS. 2, 3. Up to this point after startup, controlled pressure $P_c$ within chamber 100 is still at $P_n$. When $P_i$ reaches a level sufficient to overcome the opposing force of spring 154 and $P_n$ acting on the left side of valve 120 as viewed in FIGS. 2, 3, the valve moves from its first position towards its second position, bringing passage 142 into fluid communication with passage 134 via annular valve groove 136 (FIG. 3).

Discharge pressure fluid, which may be refrigerant gas or oil, then begins to flow from second discharge chamber 44 or sump 26, respectively, as the case may be, into chamber 100. At this point, $P_c$ has risen to a level greater than $P_n$, to a level approximating discharge pressure, and acts in conjunction with compression spring 154 to move valve 120 back into its first position, closing communication between passages 142 and 134 (FIG. 2). Should $P_c$ exceed $P_i$ by more than 5 to 10 psi, a small portion of the fluid will flow through check valve assembly 170 and back to space 108 via conduit 102, after which it will be discharged through port 40. If the axial compliance medium is oil, any of this back-flowing fluid which reaches space 108 will provide additional lubrication of the surfaces of the interleaved scroll wraps. Substantially beneficial lubrication between the scroll wrap flanks and/or the interfacing wrap tips and scroll faces may occur over the course of normal compressor operation, during which oil serving as the axial compliance medium may be repeatedly discharged through conduit 102 into space 108.

During steady compressor operation, valve 120 will remain in its first position (FIG. 2) and $P_c$ will remain no greater than the sum of Pi and minimum check valve opening pressure. Should suction pressure drop, however, $P_i$ will also drop, and an additional quantity of the fluid in chamber 100 will be expelled through check valve 170 when $P_c$ reaches the sum of $P_i$ and the check valve opening pressure. Thus the force with which piston 80 acts on orbiting scroll surface 84 will be reduced, self-adjusting the axial compliance force to properly match the reduced separation forces between the scroll members.

Conversely, should suction pressure rise during compressor operation, $P_i$ will also rise, and valve 120 will accordingly begin to move from its first towards its second position against spring 154 and $P_c$, allowing additional discharge pressure gas or oil, as the case may be, to flow into chamber 100 through valve groove 136. Thus the force with which piston 80 acts on orbiting scroll surface 84 will be increased, self-adjusting the axial compliance force to properly match the increased separation forces between the scroll members. As operating conditions fluctuate during the operation of compressor assembly 10, valve 120 and its check valve 170 will repeatedly cycle as described above, automatically regulating the axial compliance force upon orbiting scroll member 30 to maintain its proper axial engagement with fixed scroll member 28.

Figure 5:
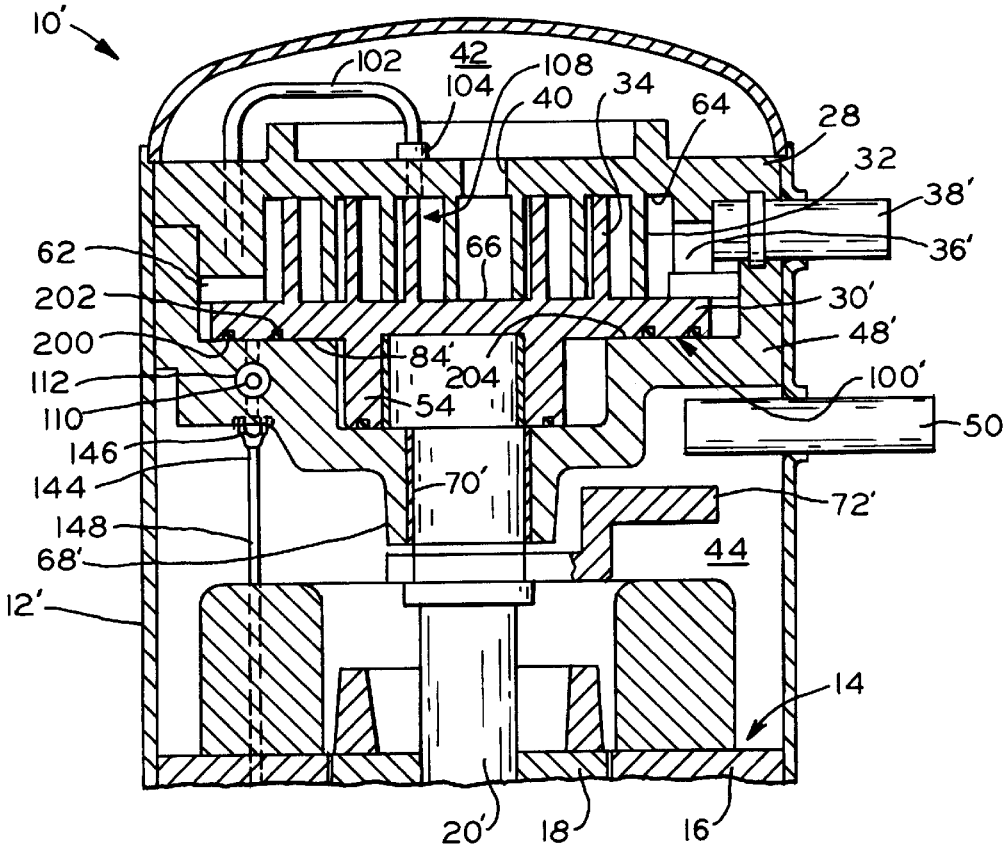
FIG. 5 is a longitudinal, fragmentary sectional view of a scroll compressor assembly according to a second embodiment of the present invention.

Referring now to FIG. 5, there is shown compressor assembly 10', a second embodiment of a compressor assembly according to the present invention. Although compressor assembly may be otherwise identical to compressor assembly 10 except in that it does not comprise annular piston 80 disposed in cavity 74 and which slidably contacts the underside of orbiting scroll member 30 with varying force, it can be seen that compressor assembly 10' as shown also differs from compressor assembly 10 in that counterweight 72' is not disposed in a suction cavity, but rather is located in discharge cavity 44'. Further, suction cavity 36' is disposed adjacent the entrance to the space between the scroll wraps, with suction tube 38' extending directly thereinto. Moreover, frame 48' has main bearing portion 68' which has only one bearing (70') for radially supporting shaft 20'. The terminal end of shaft 20' is radially and axially supported by an outboard bearing (not shown) disposed in the lower portion of housing 12'.

In compressor assembly 10', the fluid medium acts directly on the underside of orbiting scroll member 30', rather than through a moveable annular piston, for maintaining the scroll members into proper axial engagement with each other. The axial compliance fluid medium (again, gas or oil) is contained and works within generally flat, annular chamber 100' defined by orbiting scroll underside surface 84', facing surface 204 of frame 48, and annular seals 200, 202 disposed in concentric annular grooves provided in surface 84' and between which passages 132' and 134' are located. Passages 132', 134' are not shown, but fluidly communicate chamber 100' and valve 120' in the manner described above with respect to compressor assembly 10. Seals 200, 202 may, of course, be instead disposed in concentric annular grooves provided in frame surface 204, with passages 132', 134' located therebetween. Seals 200,

202 are compressible and resilient, and seal chamber 100' in all the varying axial compliance positions of orbiting scroll member 30'.

Within chamber 100', controlled pressure $P_{c'}$ of the gas or liquid axial compliance medium may differ from $P_c$ of compressor assembly 10 because of differences in the areas on which the axial compliance mediums act in these compressors. Further, because $P_{c'}$ may differ from $P_c$, the dimensional size and/or operating characteristics of valve 120', check valve assembly 170' and spring 154' of compressor assembly 10', none of which are shown but which correspond to valve 120, check valve assembly 170 and spring 154 of compressor assembly 10, may also require appropriate adjustment. The axial compliance mechanisms of compressors 10 and 10' are otherwise identical and function in the same way.

While this invention has been described as having exemplary designs, the present invention may be further modified within the spirit and scope of this disclosure. This application is, therefore, intended to cover any variations, uses, or adaptations of the invention using its general principles. Further, this application is intended to cover such departures from the present disclosure as come within known or customary practice in the art to which this invention pertains. Accordingly, the scope of the invention should be determined not by the illustrated embodiments but by the following claims and their legal equivalents.

What is claimed is:

1. A scroll compressor assembly comprising:

a first scroll device having a first involute wrap element projecting from a first substantially planar surface;

a second scroll device having a second involute wrap element projecting from a second substantially planar surface, and a third surface opposite said second surface, said first and second scroll devices in mutual engagement with said first involute wrap element projecting toward said second surface and said second involute wrap element projecting toward said first surface, said first and second surfaces substantially parallel; whereby relative orbiting motion of said first and second surfaces compresses fluids between said involute wrap elements;

a first source of a first fluid under a pressure intermediate suction pressure and discharge pressure, said first source located between said engaged first and second scroll wrap elements;

a frame partly defining a chamber containing a quantity of a second fluid under pressure, said chamber in communication with said second scroll device; and a valve in fluid communication with said first source of said first fluid and a second source of said second fluid substantially at discharge pressure, said chamber and said second source out of communication in a first valve position, said chamber and said second source in communication in a second valve position, said valve activated by the fluid pressure of said first source;

whereby said first and second scroll wrap elements are maintained in controlled axial sealing engagement against said second and first surfaces, respectively.

2. The scroll compressor assembly of claim 1, wherein said third surface partly defines said chamber.

3. The scroll compressor assembly of claim 2, wherein said second scroll device is a scroll member.

4. The scroll compressor assembly of claim 1, wherein said second scroll device is a scroll member and a piston.

5. The scroll compressor assembly of claim 4, wherein said scroll member has said third surface, said piston in sliding contact with said third surface.

6. The scroll compressor assembly of claim 4, wherein said piston partly defines said chamber.

7. The scroll compressor assembly of claim 1, wherein said first scroll device comprises a fixed scroll member and said second scroll device comprises an orbiting scroll member.

8. The scroll compressor assembly of claim 1, wherein said valve is biased into its said first position.

9. The scroll compressor assembly of claim 8, wherein said valve is biased into its said first position by a spring.

10. The scroll compressor assembly of claim 1, wherein said valve is actuated by fluid pressure differentials existing between said first source and said chamber.

11. The scroll compressor assembly of claim 10, wherein said valve has a passage extending therethrough and a check valve, said check valve having a closed position in which flow through said passage is substantially blocked, said check valve biased into said closed position, said check valve having an open position in which said chamber is in communication with said first source through said passage.

12. The scroll compressor assembly of claim 11, wherein said check valve is activated by fluid pressure differentials existing between said chamber and said first source.

13. The scroll compressor assembly of claim 11, wherein said valve is generally cylindrical and slides in a bore provided in said frame, said passage extending along the central axis of said valve, said valve having an outer surface provided with an annular groove, said groove in communication with said second source in said first and second valve positions, said groove in communication with said chamber in said second valve position, said groove substantially out of communication with said chamber in said first valve position.

14. The scroll compressor assembly of claim 13, wherein said first source is in communication with a first axial end of said valve and with said check valve, and said chamber is in communication with a second axial end of said valve opposite said first end and with said check valve.

15. The scroll compressor assembly of claim 1, wherein said first scroll member is provided with an aperture extending from said first surface, said aperture connected to a conduit through which said first source and said valve are in communication.

16. The scroll compressor assembly of claim 1, wherein said second fluid is a gas.

17. The scroll compressor assembly of claim 16, wherein said second source is a discharge gas chamber.

18. The scroll compressor assembly of claim 1, wherein said second fluid is a liquid.

19. The scroll compressor assembly of claim 18, wherein said second source is an oil sump.

20. The scroll compressor assembly of claim 19, further comprising a housing, said oil sump disposed in a lower portion of said housing.

21. The scroll compressor assembly of claim 20, wherein the interior of said housing is substantially at discharge pressure.

22. The scroll compressor assembly of claim 21, wherein oil in said oil sump is substantially at discharge pressure.

23. The scroll compressor assembly of claim 22, wherein said valve and said second source are in communication through a conduit which extends from said valve to a location below the surface level of oil in said sump, whereby oil is forced through said conduit under the force of discharge pressure.

24. The scroll compressor assembly of claim 1, wherein said frame has a cavity in which is disposed a moveable piston, said piston in communication with said third surface of said second scroll device, said chamber defined in part by said cavity and at least one surface of said piston.

25. The scroll compressor assembly of claim 24, wherein said piston is annular, a first axial surface of said piston partly defining said chamber, a second axial surface opposite said first axial surface in sliding engagement with said third surface of said second scroll device.

26. The scroll compressor assembly of claim 25, wherein said annular piston has inner and outer radial surfaces each in sliding contact with respective, adjacent inner and outer radial surfaces of said cavity.

27. The scroll compressor assembly of claim 26, wherein said annular piston comprises a plurality of second axial piston surfaces, each said second axial piston surface separated from an adjacent said second axial piston surface by a recess extending radially between said inner and outer radial piston surfaces.

28. The scroll compressor assembly of claim 26, wherein a first annular groove is provided in said inner radial surface of one of said piston and said cavity and a second annular groove is provided in said outer radial surface of one of said piston and said cavity, a seal provided in each of said first and second annular grooves.

29. A scroll compressor assembly comprising:

a first scroll member having a first involute wrap element projecting from a first substantially planar surface;

a second scroll member having a second involute wrap element projecting from a second substantially planar surface, and a third surface opposite said second surface, said first and second scroll members adapted for mutual engagement with said first involute wrap element projecting toward said second surface and said second involute wrap element projecting toward said first surface, said first surface positioned substantially parallel with said second surface, whereby relative orbiting motion of said scroll members compresses fluids between said involute wrap elements;

a first source of a first fluid under a pressure intermediate suction pressure and discharge pressure, said first source located between said first and second scroll wrap elements;

a frame partly defining a chamber containing a quantity of a second fluid under pressure; and a valve in fluid communication with said first source of said first fluid and a second source of said second fluid substantially at discharge pressure, said chamber and said second source out of communication in a first valve position, said chamber and said second source in communication in a second valve position, said first fluid pressure being a valve position control pressure;

the magnitude of the pressure of said second fluid within said chamber positively correlated to the magnitude of a force exerted on said third surface of said second scroll member, whereby said first and second scroll members are maintained in controlled axial sealing engagement by said force.

30. The scroll compressor assembly of claim 29, wherein said first scroll member is a fixed scroll member and said second scroll member is an orbiting scroll member.

31. The scroll compressor assembly of claim 29, wherein said valve is biased into its said first position.

32. The scroll compressor assembly of claim 31, wherein said valve is biased into its said first position by a spring.

33. The scroll compressor assembly of claim 29, wherein said valve has a passage extending therethrough and a check valve, said check valve having a closed position in which flow through said passage is substantially blocked, said check valve biased into said closed position, said check valve having an open position in which said chamber is in communication with said first source through said passage.

34. The scroll compressor assembly of claim 33, wherein said valve is generally cylindrical and slides in a bore provided in said frame, said passage extending along the central axis of said valve, said valve having an outer surface provided with an annular groove, said groove in communication with said second source in said first and second valve positions, said groove in communication with said chamber only in said second valve position.

35. The scroll compressor assembly of claim 34, wherein said first source is in communication with a first axial end of said valve and with said check valve, and said chamber is in communication with a second axial end of said valve opposite said first end.

36. The scroll compressor assembly of claim 29, wherein said first scroll member is provided with an aperture extending from said first surface, said aperture connected to a conduit through which said first source and said valve are in communication.

37. The scroll compressor assembly of claim 29, wherein said second fluid is a gas.

38. The scroll compressor assembly of claim 37, wherein said second source is a discharge gas chamber.

39. The scroll compressor assembly of claim 29, wherein said second fluid is a liquid.

40. The scroll compressor assembly of claim 29, wherein said second source is an oil sump.

41. The scroll compressor assembly of claim 40, further comprising a housing, said oil sump disposed in a lower portion of said housing.

42. The scroll compressor assembly of claim 41, wherein the interior of said housing is substantially at discharge pressure.

43. The scroll compressor assembly of claim 42, wherein oil in said oil sump is substantially at discharge pressure.

44. The scroll compressor assembly of claim 43, wherein said valve and said second source are in communication through a conduit which extends from said valve to a location below the surface level of oil in said sump, whereby oil is forced through said conduit under force of discharge pressure.

45. The scroll compressor assembly of claim 29, wherein said frame has a cavity in which is disposed a moveable piston, said piston in communication with said third surface of said second scroll member, said chamber defined in part by said cavity and at least one surface of said piston.

46. The scroll compressor assembly of claim 45, wherein said piston is annular, a first axial surface of said piston partly defining said chamber, a second axial surface opposite said first axial surface in sliding engagement with said third surface of said second scroll member.

47. The scroll compressor assembly of claim 46, wherein said annular piston has inner and outer radial surfaces each in sliding contact with respective, adjacent inner and outer radial surfaces of said cavity.

48. The scroll compressor assembly of claim 47, wherein said annular piston comprises a plurality of second axial piston surfaces, each said second axial piston surface separated from an adjacent said second axial piston surface by a recess extending radially between said inner and outer radial piston surfaces.

49. The scroll compressor assembly of claim 47, wherein a first annular groove is provided in said inner radial surface of one of said piston and said cavity and a second annular groove is provided in said outer radial surface of one of said piston and said cavity, a seal provided in each of said first and second annular grooves.

50. The scroll compressor assembly of claim 29, wherein said chamber is defined in part by said third surface of said second scroll member.

51. A scroll compressor assembly comprising:

a first scroll device having a first involute wrap element projecting from a first substantially planar surface;

a second scroll device having a second involute wrap element projecting from a second substantially planar surface, and a third surface opposite said second surface, said first and second scroll devices adapted for mutual engagement with said first involute wrap element projecting toward said second surface and said second involute wrap element projecting toward said first surface, said first surface positioned substantially parallel with said second surface, whereby relative orbiting motion of said scroll devices compresses fluids between said involute wrap elements;

a first source of a first fluid under a pressure intermediate suction pressure and discharge pressure, said first source located between said first and second scroll wrap elements;

a second source of a second fluid, said second source being substantially at discharge pressure;

a frame partly defining a chamber containing a quantity of said second fluid under pressure, the pressure of said second fluid in said chamber being transmitted to said third surface; and means for automatically controlling the axial compliance forces between said first and second scroll devices, said automatic control means comprising means for introducing said second fluid into said chamber from said second source in response to an increase in the pressure of said first fluid, whereby the pressure of said second fluid in said chamber and the axial compliance force between the first and second scroll devices is increased, and means for removing said second fluid from said chamber in response to a decrease in pressure of said first fluid, whereby the pressure of said second fluid in said chamber and the axial compliance force between the first and second scroll devices is decreased.

* * * * *